US010269338B2

(12) United States Patent
Hong et al.

(10) Patent No.: US 10,269,338 B2
(45) Date of Patent: Apr. 23, 2019

(54) WALL AND FLOOR STRUCTURE FOR REDUCING INTER-FLOOR NOISE

(71) Applicant: Korea Advanced Institute of Science and Technology, Daejeon (KR)

(72) Inventors: Jung-Wuk Hong, Yongin-si (KR); Seung-Jin Yang, Suwon-si (KR); Sang-Eon Lee, Incheon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 200 days.

(21) Appl. No.: 15/319,851

(22) PCT Filed: Jul. 21, 2015

(86) PCT No.: PCT/KR2015/007521
§ 371 (c)(1),
(2) Date: Dec. 19, 2016

(87) PCT Pub. No.: WO2016/013835
PCT Pub. Date: Jan. 28, 2016

(65) Prior Publication Data

US 2017/0138042 A1 May 18, 2017

(30) Foreign Application Priority Data

Jul. 22, 2014 (KR) ..... 10-2014-0092735
Jun. 30, 2015 (KR) ..... 10-2015-0093616

(51) Int. Cl.
*E04F 15/20* (2006.01)
*E04B 1/82* (2006.01)
(Continued)

(52) U.S. Cl.
CPC ..... *G10K 11/168* (2013.01); *E04F 15/203* (2013.01); *E04B 2001/8263* (2013.01); *H04R 1/345* (2013.01)

(58) Field of Classification Search
CPC ..... E04F 15/203; E04F 15/206
(Continued)

(56) References Cited

U.S. PATENT DOCUMENTS 8,066,097 B2 * 11/2011 Boyadjian ..... E04F 13/08 181/285
8,347,575 B2 * 1/2013 Bierwirth ..... E04F 15/182 181/284
(Continued)

FOREIGN PATENT DOCUMENTS

JP 3399279 B2 4/2003
JP 2005-099402 A 4/2005
(Continued)

OTHER PUBLICATIONS

English Translation for KR 20100049778 A, accessed Aug. 30, 2018 from KIPRIS.*
(Continued)

*Primary Examiner* — Jeremy A Luks
(74) *Attorney, Agent, or Firm* — Daly, Crowley Mofford & Durkee, LLP

(57) ABSTRACT

A hard panel of wall and floor structures for reducing floor impact sound according to example embodiments includes patterned layer having different density and elastic modulus form a base layer. A transmission path of an acoustic wave may be changed in a lateral direction by passing the patterned layer and the sound energy is dissipated by the refection, refraction, and cancellation of the acoustic wave. Thus, a noise is reduced.
The hard panel of the wall and floor structures according to example embodiments is effectively reduces the light and heavy impact sounds. In addition, the hard panel is formed by at least one patterned layer to refract and reflect the acoustic wave such that the floor noise may be effectively dissipated. The hard panel is further includes the sound
(Continued)

absorbing material to absorb the noise passing through the hard panel such that the floor noise can be effectively reduced.

13 Claims, 16 Drawing Sheets

(51) Int. Cl.
*G10K 11/168* (2006.01)
*H04R 1/34* (2006.01)

(58) Field of Classification Search
USPC ..... 181/286, 290
See application file for complete search history.

(56) References Cited

U.S. PATENT DOCUMENTS 8,631,899 B2 * 1/2014 Zickmantel ..... G10K 11/168 181/286
9,133,616 B2 * 9/2015 Cheung ..... C04B 28/02
2005/0263346 A1 * 12/2005 Nishimura ..... E04B 1/86 181/290
2014/0245693 A1 * 9/2014 Efros ..... E04F 15/0215 52/741.4

FOREIGN PATENT DOCUMENTS

| | | | |
|---|---|---|---|
| JP | 2006-119228 | A | 5/2006 |
| KR | 10-2006-0099838 | A | 10/2006 |
| KR | 10-2010-0000275 | A | 1/2010 |
| KR | 10-2010-0030277 | A | 3/2010 |
| KR | 10-2010-0049778 | A | 5/2010 |
| KR | 10-2010-0067848 | A | 6/2010 |
| WO | WO 2016/013835 | A1 | 1/2016 |

OTHER PUBLICATIONS

English Translation for JP 2005099402 A, accessed Aug. 30, 2018 from JPO.*
International Search Report dated Sep. 22, 2015; for Patent Application PCT/KR2015/007521; 5 pages.
Korean Office Action (with English Translation) dated Mar. 29, 2017 for Korean Application No. 10-2015-0093616; 24 Pages.

* cited by examiner (a)

(b)

(a)

(b)

WALL AND FLOOR STRUCTURE FOR REDUCING INTER-FLOOR NOISE

This application is a U.S. National Stage of PCT/KR2015/007521 filed in the Korean language on Jul. 21, 2015 entitled: "Wall And Floor Structure For Reducing Inter-Floor Noise" which application claims priority to Korean Application No. 10-2014-0092735 filed on Jul. 22, 2014and Korean Application No. 10-2015-0093616 filed on Jun. 30, 2015, which applications are each hereby incorporated herein by reference in their entireties.

BACKGROUND

1. Field

Example embodiments of the inventive concept relate to wall and floor structures for reducing floor impact sound. More particularly, example embodiments of the inventive concept relate to techniques for reducing floor impact sound in the wall and floor structures by changing a direction of an acoustic wave and dissipating sound energy with a panel having a patterned layer formed using materials having different densities and elastic modulus.

2. Discussion of Related Art

Because of the rapid urbanization, the majority of people live in apartment houses. Therefore, there are many floor noise problems and conflicts are deepening and being raised as social issues.

Floor impact sound of the floor noises is divided into a light impact sound and a heavy impact sound according to the impact characteristics. The light impact sound is an upper register sound of 58bB or less with a light and hard sound, such as dragging a table, garlic clenching, falling objects, etc. The light impact sound has a low impact force and short acoustic duration. The heavy impact sound is a lower register sound, such as sounds of children's beats, footsteps, etc. The heavy impact sound has physical characteristics that impact force is large and acoustic duration is long, and it is difficult to reduce it.

In order to solve the floor noise, shock absorbing materials such as a fibrous mat, a rubber-base mat, or a porous resin mat is used on the floor surface, or a floating floor structure separated from the floor surface is mainly used.

Such the shock absorbing materials and floating floor structures can effectively reduce the light impact sound by about 54%, but the effect on the heavy impact sound is merely about 8%.

It is expected that a column type structure model will be applied to newly constructed apartments to reduce the floor noise. However, the column type structure model is relatively expensive, and it is applied only to newly built houses, so measures against existing apartments are necessary.

As a conventional technique, a patent document 1 provides a building material having an aerogel formed between cardboards on which a plurality of bumps are formed to have an effect on heat insulation, soundproofing, sound absorption, dustproofing and pollutant adsorption. Aerogels having a nano-porous structure between the cardboards are semi-transparent, extremely low-density, and are efficient heat insulating materials. Since the flooring materials are closely related to heating, the building material disclosed in the patent document 1 formed of the aerogel having high heat insulation is not suitable as the flooring material. In addition, aerogel is put between the cardboards having many fine pores, and the aerogel is an expensive material. Therefore the building material disclosed in the patent document 1 is not suitable as a flooring material for flooring for soundproof purposes.

PRIOR ART DOCUMENTS

Patent Documents

1. KR Publication No. 10-2013-0122407

SUMMARY

Example embodiments provide a wall structure and a floor structure for effectively reducing the light and heavy impact sounds.

According to example embodiments, a display device may comprise a hard panel having a base layer and a patterned layer formed in the base layer to generate a difference of an acoustic wave propagation speed between the patterned layer and the base layer and a difference of acoustic impedance between the patterned layer and the base layer.

In example embodiments, a medium of the patterned layer may be different from a medium of the base layer.

In example embodiments, a material of a medium of the patterned layer may be substantially the same as the base layer and a density of the patterned layer may be different from the base layer.

In example embodiments, a material of a medium of the patterned layer is substantially the same as the base layer and an elastic modulus of the patterned layer may be different from the base layer.

In example embodiments, the patterned layer may have a semicircle pattern or a polygonal pattern In example embodiments, a density of medium of the patterned layer may be greater than the base layer.

In example embodiments, a density of medium of the patterned layer may be less than the base layer.

In example embodiments, an elastic modulus of medium of the patterned layer may be greater than the base layer.

In example embodiments, an elastic modulus of medium of the patterned layer may be less than the base layer.

In example embodiments, the patterned layer may be formed by a single layer or a multi-layer.

In example embodiments, a medium of the hard panel may comprise at least one of polyvinyl chloride (PVC), aluminum, acrylonitrile butadiene styrene (ABS) resin, polylactic acid (PLA), metal, fiber, rubber, concrete, and mortar.

In example embodiments, the hard panel may further comprise a sound absorbing material between adjacent patterns of the patterned layer.

In example embodiments, a method manufacturing the hard panel of the wall and floor structures for reducing floor impact sound may comprise manufacturing the hard panel by a 3D printer.

In example embodiments, a method manufacturing the hard panel of the wall and floor structures for reducing floor impact sound may comprise manufacturing a mold and mixing materials having different properties.

In example embodiments, a construction method using a plurality of hard panels of the wall and floor structures for reducing floor impact sound may comprise forming the hard panels each having a square mat with a tile type, and bonding the hard panels using an adhesive In example embodiments, the construction method may further comprise placing a combination of the hard panels in a checkerboard arrangement or a zigzag arrangement on the floor of an existing building.

In example embodiments, the hard panels may be reclaimed in the floor of a newly-built building. The hard panels may be included in at least one of a concrete slab, a lightweight aerated concrete, a finishing mortar, and a floor covering material.

In example embodiments, the hard panels of the wall and floor structures for reducing floor impact sound may be placed on the wall or floor. However, it is not limited thereto.

According to example embodiments, a hard panel of wall and floor structures for reducing floor impact sound may comprise a patterned layer having a hemispherical shape or a pyramid shape so that an acoustic wave of a noise is refracted or scattered in a lateral direction of the hard panel when the noise strikes a floor and a wall, the hemispherical shape and the pyramid shape having a wide one side and a narrow opposite side, and a base layer surrounding the patterned layer and extending a transmission path of the noise to reduce the noise propagated to the floor and wall.

In example embodiments, a method manufacturing the hard panel of the wall and floor structures for reducing floor impact sound may comprise manufacturing a mold and forming the hard panel by the mold.

In example embodiments, the hard panel may be manufactured by fixing with an adhesive and a hook.

In example embodiments, a construction method using a plurality of hard panels of the wall and floor structures for reducing floor impact sound may comprise curing the hard panels using an upper mold.

In example embodiments, the hard panels may be between a concrete slab and a lightweight aerated concrete, between the lightweight aerated concrete and a finishing mortar, and between the finishing mortar and a floor covering material when the hard panels are reclaimed in the floor of an existing building or a newly-built building.

In example embodiments, the hard panels may be included in at least one of a concrete slab, a lightweight aerated concrete, a finishing mortar, and a floor covering material when the hard panels are reclaimed in the floor of an existing building or a newly-built building.

In example embodiments, the hard panels may be placed as an external flooring on the floor of an existing building or a newly-built building.

In example embodiments, the hard panels may be placed as a floor structure of an existing building or a newly-built building.

In example embodiments, the hard panels may be placed as a wall structure of an existing building or a newly-built building.

Therefore, the hard panel of the wall and floor structures according to example embodiments may effectively reduce the light and heavy impact sounds.

In addition, the hard panel may be formed by at least one patterned layer to refract and reflect the acoustic wave such that the floor noise may be effectively dissipated.

The hard panel may further include the sound absorbing material to absorb the noise passing through the hard panel such that the floor noise may be effectively reduced.

The hard panel may be applied to existing buildings, and thus installation costs may be reduced.

Construction costs may be saved by the low cost of the hard panel.

BRIEF DESCRIPTION OF THE DRAWINGS

Example embodiments can be understood in more detail from the following description taken in conjunction with the accompanying drawings, in which.

DETAILED DESCRIPTION OF EMBODIMENTS

Figure 1:
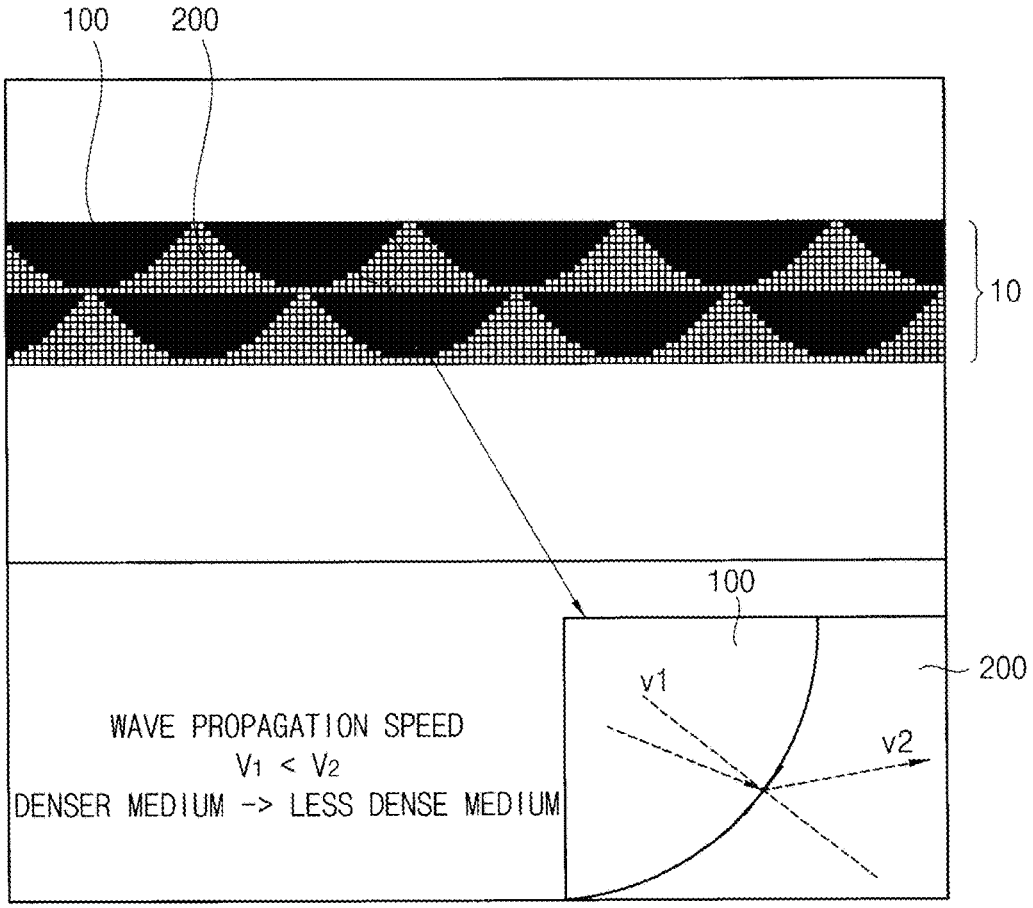
FIG. 1 is an enlarged cross-sectional view of a hard panel for reducing floor impact sound according to example embodiments.

Exemplary embodiments will be described more fully hereinafter with reference to the accompanying drawings, in which various embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity.

Exemplary embodiments may be wall and floor structures comprising a hard panel having a patterned layer for reducing floor sound impact. The patterned layer may be formed by a material having different density and elastic modulus from a base layer. Thus, incident acoustic wave may be refracted by passing the patterned layer and a moving distance of the acoustic wave may be increase, such that sound energy may be dissipated. The sound energy may be dissipated by the refection, refraction, and cancellation of the incident acoustic wave, and thus the floor noise may be reduced.

The patterned layer of the hard panel according to example embodiments may be two and/or three dimensional patterned layers regularly or randomly arranged in the base layer. Density and/or elastic modulus of the patterned layer may be different from the base layer.

FIG. 1 is an enlarged cross-sectional view of a hard panel 10 for reducing floor impact sound according to example embodiments. An incident acoustic wave perpendicular to the hard panel 10 may pass through a patterned medium and a direction of the acoustic wave WS may change in a horizontal direction of the hard panel based on a variation of an acoustic wave propagation speed and a variation of an acoustic impedance of the medium. The direction of the acoustic wave WS may be changed in the horizontal direction of the hard panel 10 by the refraction of the acoustic wave WS so that floor noise propagated to a lower side of the hard panel may be reduced. The moving distance of the acoustic wave WS in the hard panel 10 may increase in the horizontal direction so that the acoustic wave WS (and a sound energy) may be dissipated.

In addition, some of acoustic wave WS may penetrate at a boundary between a base layer 200 and a patterned layer 100 and some of acoustic wave WS may be reflected at the boundary, so that the moving distance of the acoustic wave WS in the hard panel may be increased and sound energy dissipation may be maximized. The greater the variation of the acoustic wave propagation speed between a denser medium 320 and a less dense medium 310, the greater the refraction angle. Thus, it is preferable that the variation of the acoustic wave propagation speed or the acoustic impedance is large when the acoustic wave WS moves form the denser medium 320 to the less dense medium 310 or form the less dense medium 310 to the denser medium 320.

Figure 2:
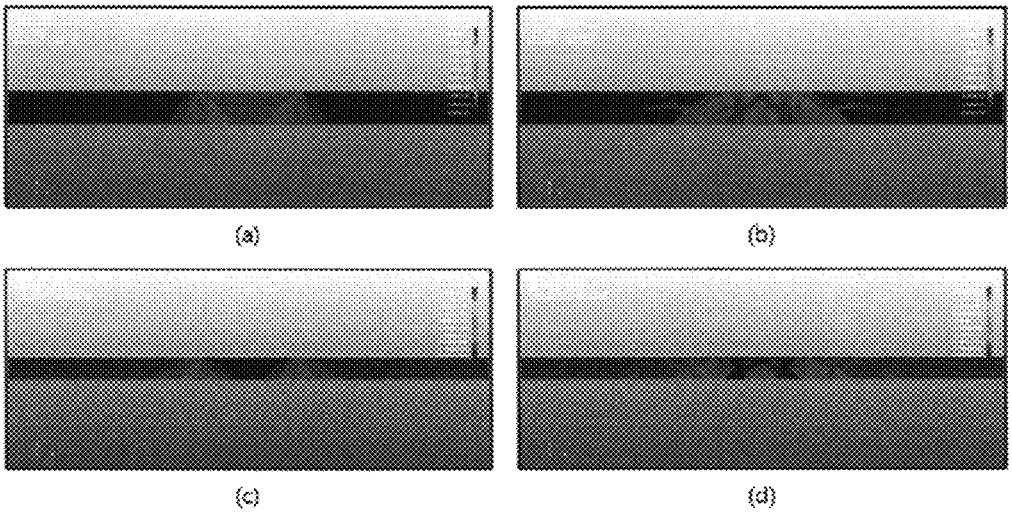
FIG. 2 is an analysis diagram illustrating examples of simulations of acoustic wave propagation according to example embodiments.

FIG. 2 is an analysis diagram illustrating examples of simulations of acoustic wave propagation according to example embodiments.

In FIG. 2, FIG. 2 (*a*) and FIG. 2 (*b*) are simulations of a stress distribution using Von Mises stress contour lines when a numerical value of a heavy impact sound is a peak. In FIG. 2, FIG. 2 (*c*) and FIG. 2 (*d*) are simulations of vertical stress distribution. The stress simulation conditions may be shown in Table 1.

In FIG. 2, FIG. 2 (*a*) shows a Von Mises stress distribution of the acoustic wave WS of the floor noise in the hard panel not including the patterned layer and shows that the acoustic wave WS from an upper side of the hard panel is transmitted to the lower side of the hard panel without refraction. In FIG. 2, FIG. 2 (*b*) shows that the stress concentration is dispersed because the semicircular pattern (i.e., the patterned layer 100) shown in FIG. 1 is formed in a double layer. In FIG. 2, FIG. 2 (*c*) is the vertical stress simulation in the absence of the pattern (e.g., the patterned layer 100). In FIG. 2, FIG. 2 (*d*) is the vertical stress simulation that the pattern (e.g., the patterned layer 100) is included in the hard panel 10. The direction of the acoustic wave WS transmitted from the upper side of the hard panel 10 may be refracted at the boundary between the patterned layer 100 and the base layer 200 to change the propagation direction of the acoustic wave WS horizontally. Otherwise, the acoustic wave WS may be scattered or canceled as it passes through the patterned layer 100.

TABLE 1

| | Material | Density (g/cm$^3$) | Dynamic elastic modulus (GPa) |
|---|---|---|---|
| Medium 1 | PVC | 1.55 | 2.82 |
| Medium 2 | Aluminum | 2.70 | 68 |

The acoustic wave WS propagation speed in the medium may be defined as following Equations.

$$C_L = \sqrt{\frac{E(1-\nu)}{\rho(1+\nu)(1-2\nu)}} \propto \sqrt{\frac{E}{\rho}}, \quad \text{Equation 1}$$

Longitudinal wave propagation speed, $$C_T = \sqrt{\frac{E}{2(1+\nu)\rho}} \propto \sqrt{\frac{E}{\rho}}, \quad \text{Equation 2}$$

Transverse wave propagation speed,

In Equations 1 and 2, E represents a dynamic elastic modulus, ν represents a dynamic Poisson's ratio, and ρ represents a density.

Equation 1 may define a longitudinal wave propagation speed, and Equation 2 may define a transverse wave propagation speed. The longitudinal wave propagation speed and the transverse wave propagation speed may all proportional to the dynamic elastic modulus and inversely proportional to the density.

Figure 3:
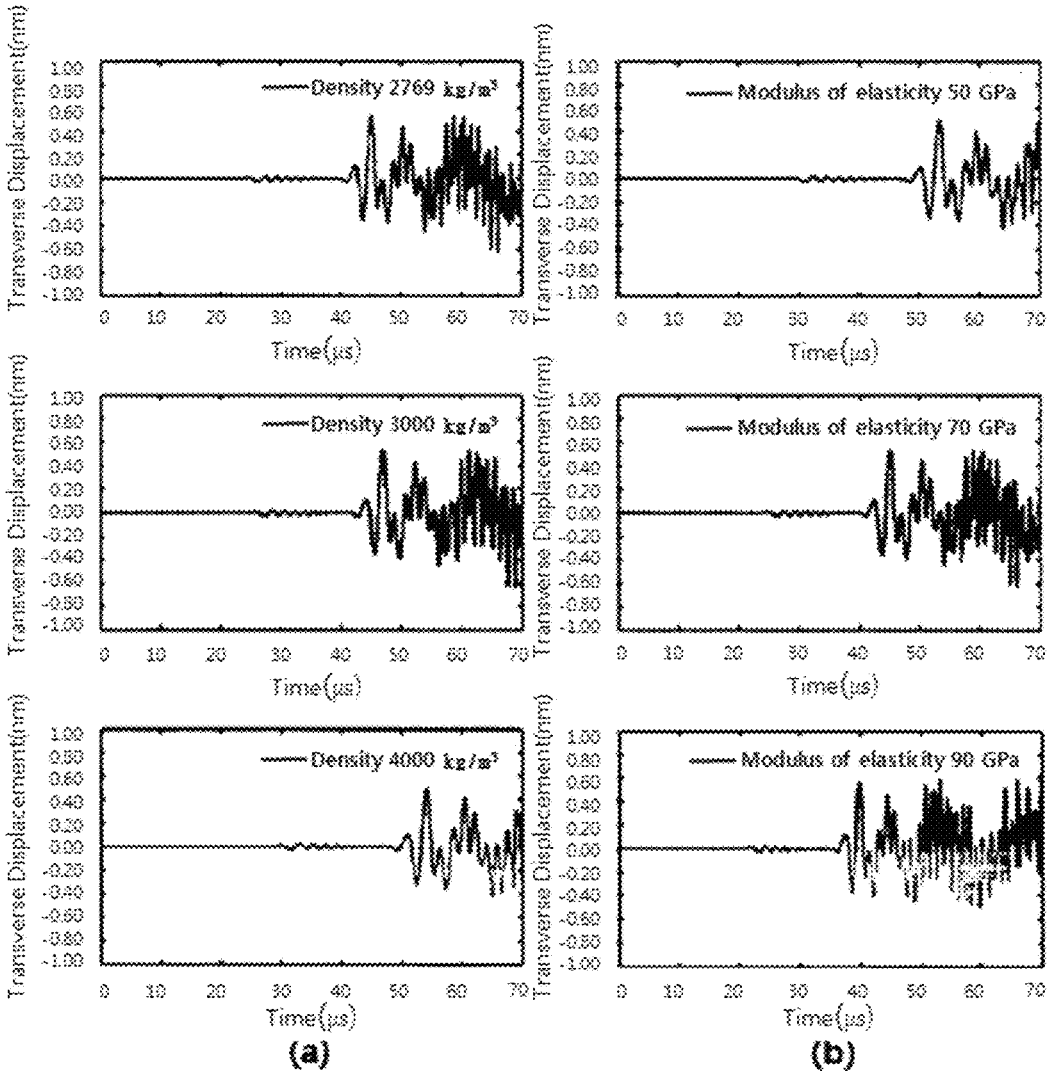
FIG. 3 is a graph illustrating an acoustic wave propagation speed according to example embodiments.

FIG. 3 is a graph illustrating an acoustic wave propagation speed according to example embodiments. FIG. 3 is a calculation of transverse displacement over time. The transverse displacement may be amplitude of the acoustic wave.

In FIG. 3 (as illustrated at (a) of FIG. 3), as the density increases, the acoustic wave propagation speed is slowed and the arrival time is delayed. In FIG. 3 (as illustrated at (b) of FIG. 3), the elastic modulus increases and the acoustic wave propagation speed increases. Thus, as the density is small or the elastic modulus is large, the acoustic wave propagation speed may increase. The acoustic wave propagation speed from the upper side of the hard panel 10 may be influenced by the elastic modulus and the density of the patterned layer 100 formed in the hard panel 10.

Figure 4:
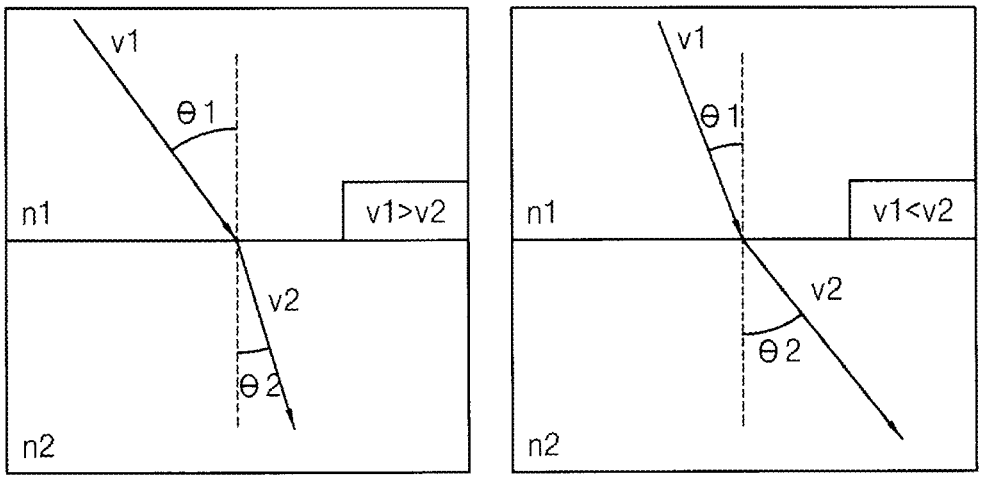
FIG. 4 is a diagram illustrating an example of acoustic wave propagation according to example embodiments.

FIG. 4 is a diagram illustrating an example of acoustic wave propagation according to example embodiments. FIG. 4 shows that the acoustic wave is transmitted from a less dense medium to a denser medium, and the acoustic wave is transmitted from the denser medium to the less dense medium.

A relation between a refractive index n and the acoustic wave propagation speed v at a boundary surface between two mediums may be defined by the Snell's law as following Equation 3.

$$\frac{n_2}{n_1} = \frac{v_1}{v_2} = \frac{\sin\theta_1}{\sin\theta_2} \qquad \text{Equation 3}$$

$$0° \le \theta_1 = \sin^{-1}\left(\frac{v_1}{v_2}\sin\theta_2\right),\ \theta_2 = \sin^{-1}\left(\frac{v_2}{v_1}\sin\theta_1\right) \le 90°$$

From the Snell's law, the refraction angle may become larger as the acoustic wave propagation speed becomes larger when the acoustic wave WS is refracted at the boundary between the mediums. The acoustic wave propagation speed in the less dense medium 310 may be faster than in the denser medium 320. When the acoustic wave WS is transmitted from the denser medium 320 to the less dense medium 310 or from the less dense medium 310 to the denser medium 320, the greater the variation of the acoustic wave propagation speed between the less dense medium 310 and the denser medium 320, the greater the refraction angle.

Based on this characteristic, the moving distance of the acoustic wave WS may be increased to dissipate the sound energy. The refraction angle of the acoustic wave WS may be proportional to the variation of the acoustic wave propagation speed between the mediums v2/v1.

Figure 5:
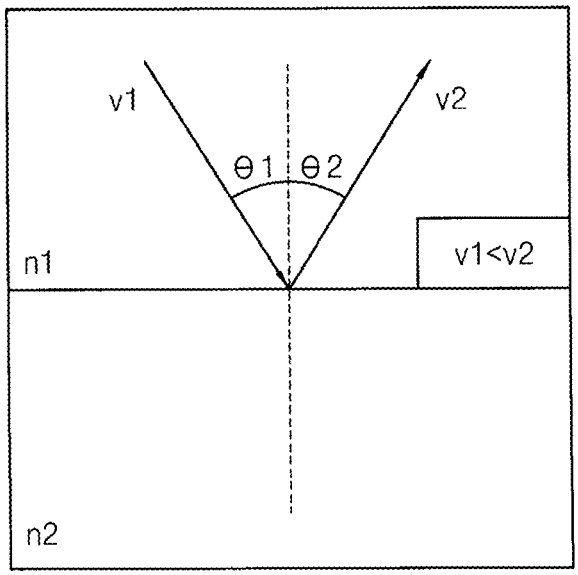
FIG. 5 is a diagram illustrating an example of a total reflection of acoustic wave according to example embodiments.

FIG. 5 is a diagram illustrating an example of a total reflection of acoustic wave according to example embodiments. For example, the acoustic wave WS is transmitted from a medium having a higher refractive index (a denser medium 320) to a medium having a lower refractive index (a less dense medium 310). In this case, the acoustic wave WS may be totally reflected back at a boundary between the mediums when an incident angle of the acoustic wave WS is larger than a critical angle. The total reflection condition may be expressed by Equation 4.

$$\frac{n_2}{n_1} = \frac{v_1}{v_2} = \frac{\sin\theta_c}{\sin 90°} \qquad \text{Equation 4}$$

$$\theta_c = \sin^{-1}\left(\frac{v_1}{v_2}\right)$$

When the acoustic wave WS is transmitted from the denser medium 320 to the less dense medium 310, the greater the variation of the acoustic wave propagation speed v2/v1, the smaller the critical angle Θc.

Assuming that a range of the variation of the acoustic wave propagation speed v2/v1 is from about 1.1 to about 2.0, the critical angle Θc may be about 30° to about 65.38°. In this, if an incident angle of the acoustic wave WS with respect to the boundary is in a range from the critical angle Θc to about 90°, the total reflection may occur without penetration. Accordingly, the incident acoustic wave and reflected acoustic wave may cancel each other out in the hard panel 10, and thus the moving distance of the acoustic distance in the hard panel 10 may increase and sound energy dissipation may increase.

Figure 6:
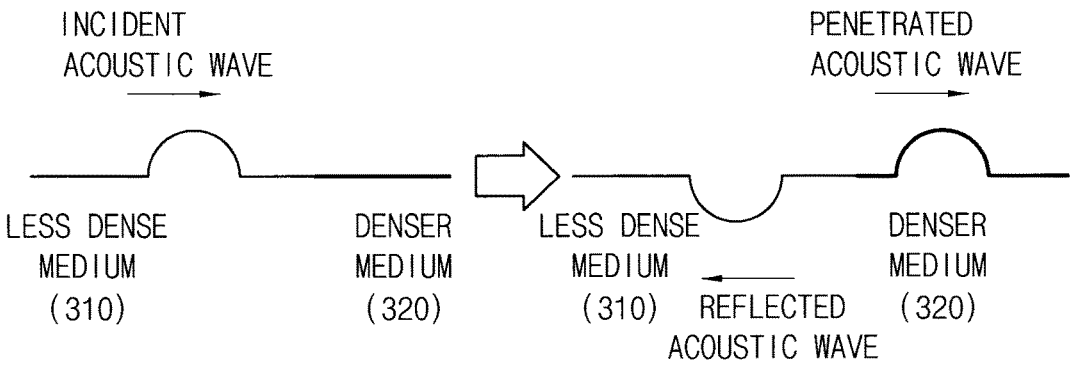
FIG. 6 is a diagram illustrating an example of a fixed-end reflection of acoustic wave according to example embodiments.

FIG. 6 is a diagram illustrating an example of a fixed-end reflection of acoustic wave according to example embodiments. When a transmitted acoustic wave WS into the hard panel 10 is reflected at a boundary between mediums and the incident acoustic wave strikes a denser medium 320, a phase of the incident acoustic wave is changed and reflected. Thus, a phase of the reflected acoustic wave of the transmitted acoustic wave that is propagating from a less dense medium 310 to the denser medium 320 may be reversed by about 180°, and the transmitted acoustic wave and the reflected acoustic wave may cancel each other out. Accordingly, a penetrated acoustic wave may be relatively reduced.

A refracted angel of the transmitted acoustic wave WS and the floor impact sound reduction may become greater as the variation of the acoustic wave propagation speed or the acoustic impedance is larger. The acoustic impedance may be expressed by Equation 5.

$$Z=\rho V \qquad \text{Equation 5}$$

In Equation 5, Z represents the acoustic impedance, ρ represents a density, V represents an acoustic wave speed. The acoustic impedance is used to evaluate acoustic absorption when determining an acoustic transmission and reflection at the boundary of two materials with different acoustic impedances.

Generally, as the longer transmission path, the less the propagation energy is inversely proportional to a distance. Particularly, when an incident angle of the acoustic wave WS onto a bottom surface of the base layer 200 is less than or equal to 90°, the acoustic wave WS at a boundary between the bottom surface of the base layer and other materials is reflected into the base layer 200 not to the other materials such as a slab layer, and thus the sound energy of noise transmitted to a floor may be sharply reduced. The acoustic wave WS may be refracted and scattered through the patterned layer 100 to be incident on the bottom surface of the base layer 200 such that the transmission path of the acoustic wave WS may be extended. The incident angle of the acoustic wave WS incident on the bottom surface of the base layer may be less than 90°, such that floor noise may be reduced.

[Embodiment 1]

In some embodiments, a material of the patterned layer 100 may be substantially the same as the base layer 200 and least one of density and elastic modulus of the patterned layer 100 may be different from the base layer 200.

Figure 7:
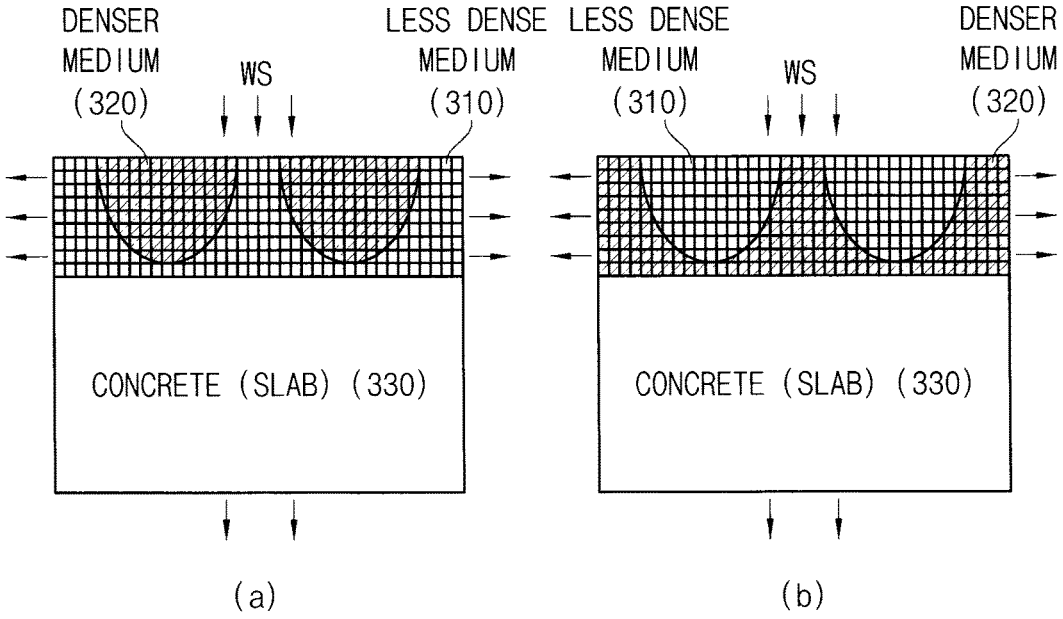
FIG. 7 is a cross-sectional view of a hard panel including a patterned layer having substantially the same material as a base layer.

FIG. 7 is a cross-sectional view of a hard panel including a patterned layer having substantially the same material as a base layer. Material property of the patterned layer 100 may be different from the base layer 200. In some embodiments, a density and an elastic modulus of the patterned layer 100 may be different from the base layer 200. The hard panel 10 may horizontally transmit an acoustic wave WS from an upper side of the hard panel 10. In FIG. 7 (as illustrated at (a) of FIG. 7), the acoustic wave WS may move from the denser medium 320 to the less dense medium 310. In FIG. 7 (as illustrated at (b) of FIG. 7), the acoustic wave WS may move from the less dense medium 310 to the denser medium 320.

Figure 8:
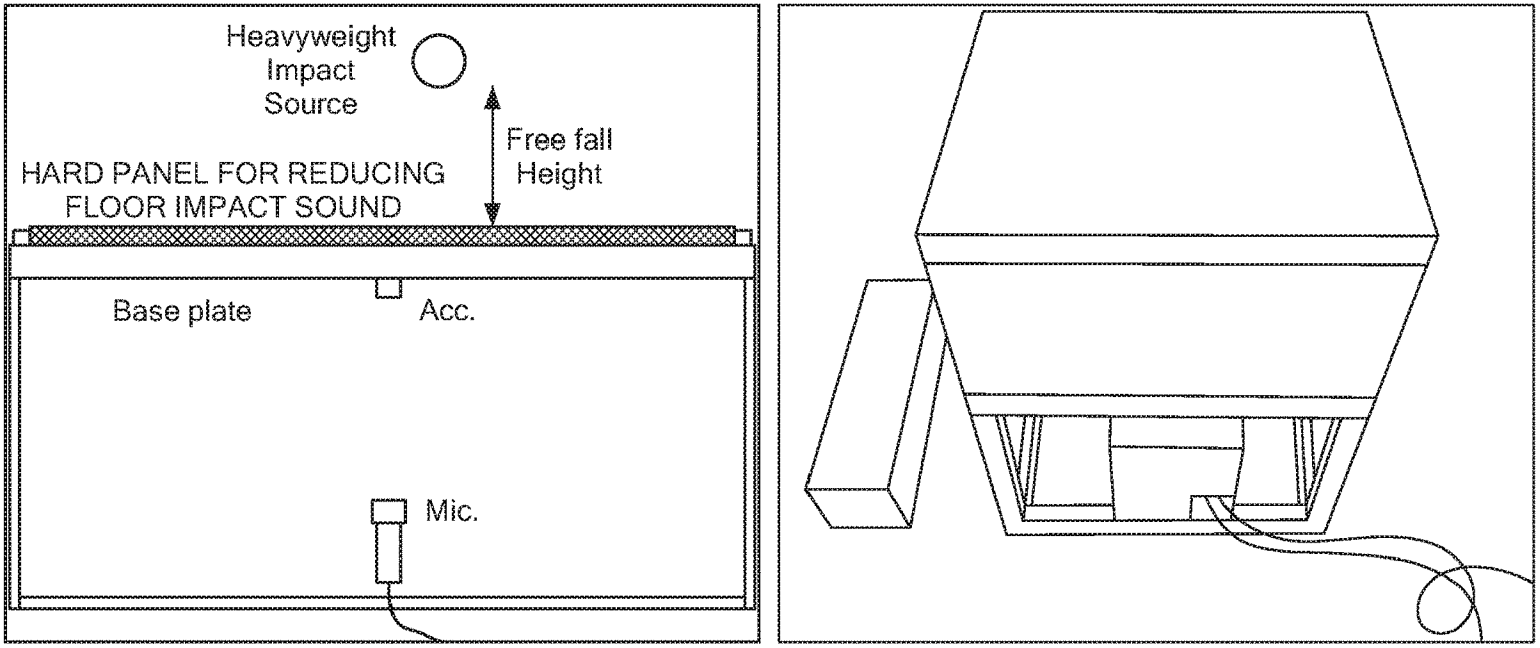
FIG. 8 is a schematic diagram illustrating a down scale model of the hard panel of FIG. 7.

FIG. 8 is a schematic diagram illustrating a down scale model of the hard panel of FIG. 7. In FIG. 8, FIG. 8 (*a*) shows a schematic diagram of the down scale model experiment. In FIG. 8, FIG. 8 (*b*) shows an actual setting for the down scale floor noise reduction model experiment using the hard panel 10. The hard panel 10 may include the patterned layer and the base layer. The patterned layer may have substantially the same material as the base layer.

Figure 9:
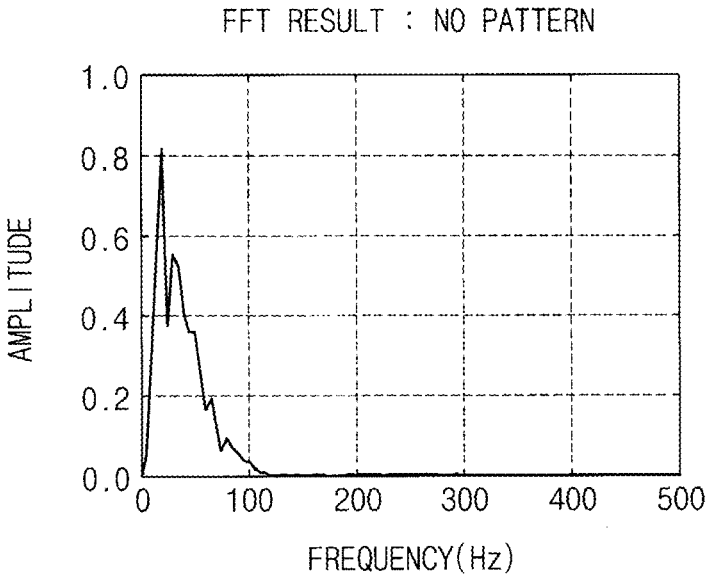
FIG. 9 is a graph illustrating a Fast Fourier Transform (FFT) result of acoustic wave reduction experiment with respect to the hard panel including a patterned layer having substantially the same material as a base layer and having different material property from the base layer.
Figure 9:
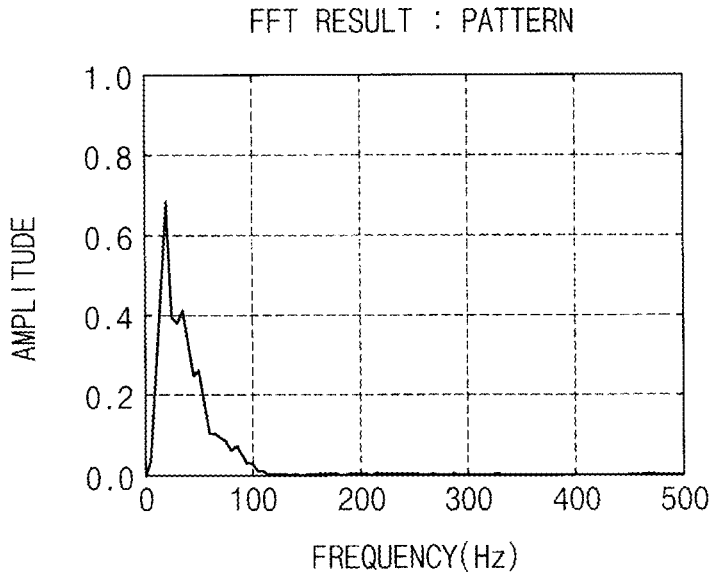

FIG. 9 is a graph illustrating a Fast Fourier Transform (FFT) result of acoustic wave reduction experiment with respect to the hard panel including a patterned layer having substantially the same material as a base layer and having different material property from the base layer. Experimental and simulation conditions of FIG. 9 are shown in Table 2.

FIG. 9 shows noise reduction results through a movement of an acoustic wave from a less dense medium to a denser medium. Particularly, in FIG. 9, FIG. 9 (*a*) shows a FTT of a sound energy according to a frequency when the patterned layer does not exist (i.e., the hard panel 10 having the patterned layer and the base layer is not included), and FIG. 9 (*b*) shows a FTT of a sound energy according to a frequency when the patterned layer is included (i.e., the hard panel 10 having the patterned layer and the base layer is included).

TABLE 2

| | Material | Density (g/cm$^3$) | Dynamic elastic modulus (GPa) |
|---|---|---|---|
| Medium 1 | Mortar | 2.32 | 27.13 |
| Medium 2 | Mortar | 1.95 | 16.01 |

The sound energy of FIG. 9 (*b*) including the patterned layer may be remarkably reduced as compared with FIG. 9 (*b*). A pattern passage order may depend on properties of the pattern.

[Embodiment 2]

In some embodiments, a material of the patterned layer 100 of the hard panel 10 may be different from the base layer 200.

Figure 10:
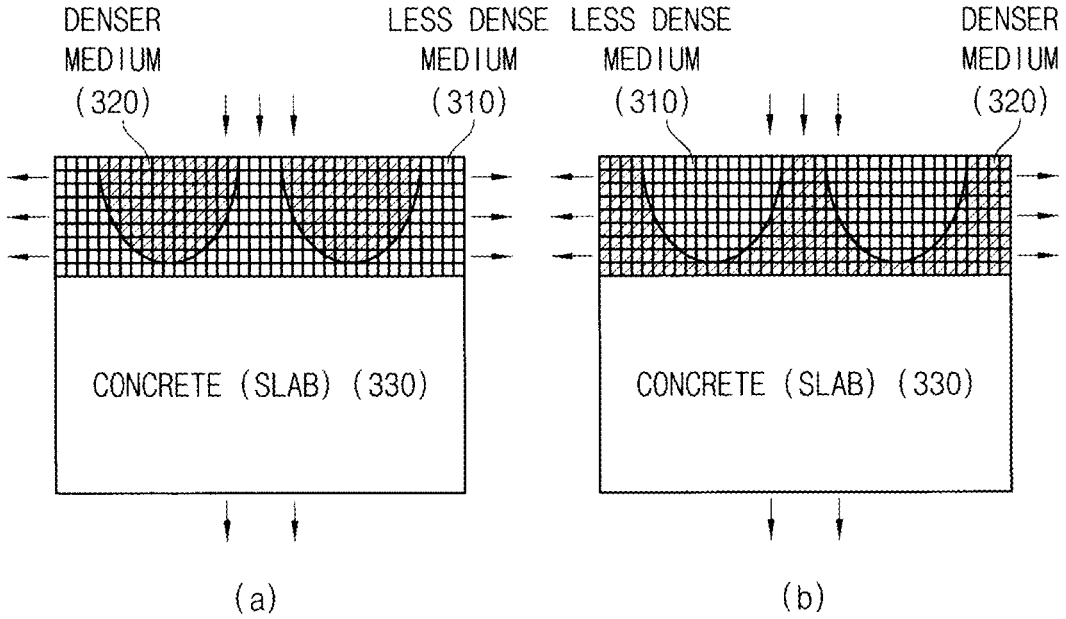
FIG. 10 is a cross-sectional view of a hard panel including a patterned layer having different material from a base layer according to example embodiments.

FIG. 10 is a cross-sectional view of the hard panel including the patterned layer having different material from the base layer. The material, a density, and an elastic modulus of the patterned layer may be different from the base layer. The hard panel 10 may horizontally transmit an acoustic wave WS from an upper side of the hard panel 10 by the Snell's law. In FIG. 10 (as illustrated at (a) of FIG. 10), the acoustic wave WS may move from the denser medium 320 to the less dense medium 310. In FIG. 10 (as illustrated at (b) of FIG. 10), the acoustic wave WS may move from the less dense medium 310 to the denser medium 320.

Figure 11:
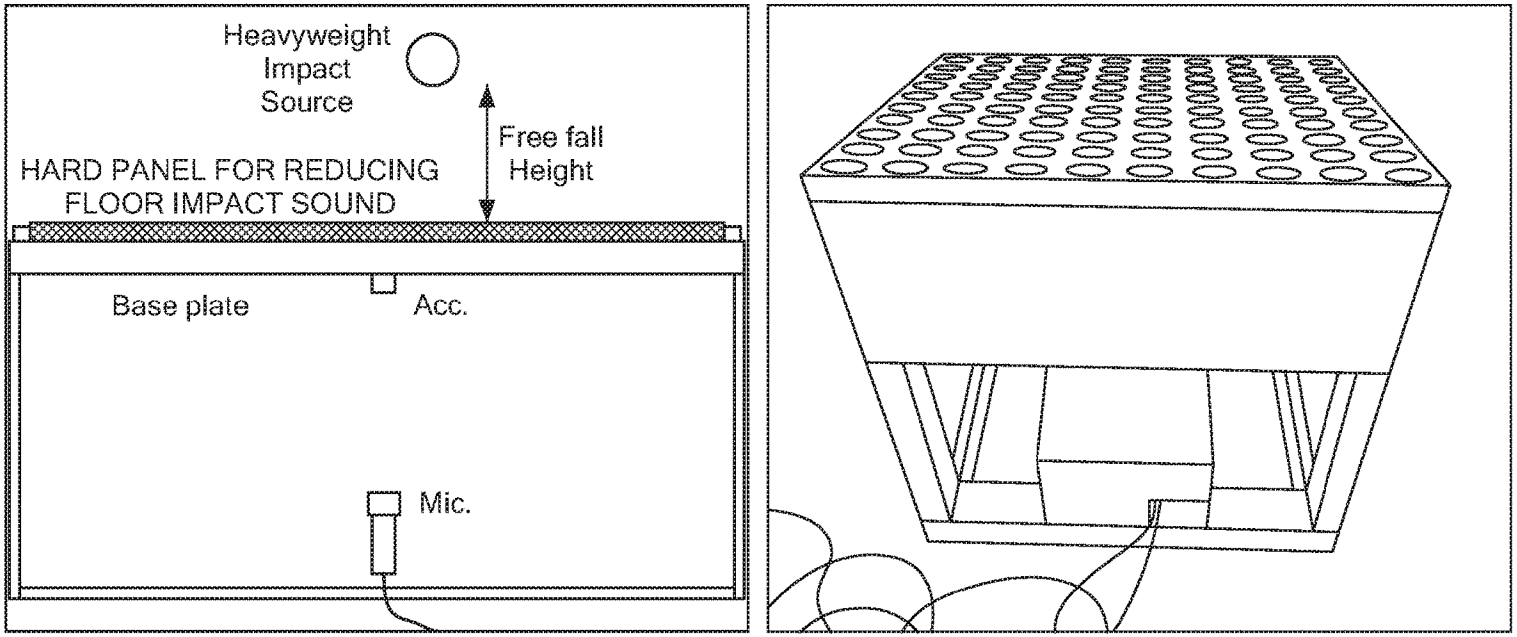
FIG. 11 is a schematic diagram illustrating a down scale model of the hard panel of FIG. 10.

FIG. 11 is a schematic diagram illustrating a down scale model of the hard panel of FIG. 10. In FIG. 11, FIG. 11 (*a*) shows a schematic diagram of the down scale model experiment. In FIG. 11, FIG. 11 (*b*) shows an actual setting for the down scale floor noise reduction model experiment using the hard panel 10. The hard panel 10 may include the patterned layer and the base layer. The patterned layer may have substantially the same material as the base layer.

Figure 12:
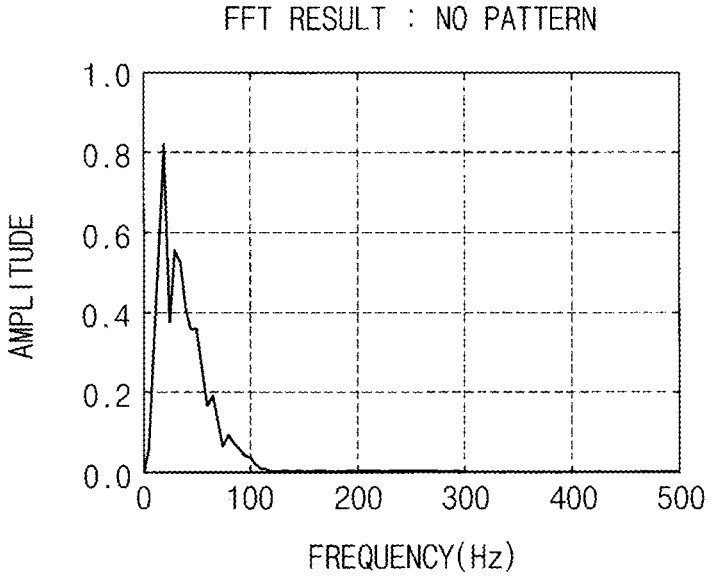
FIG. 12 is a graph illustrating a FFT result of acoustic wave reduction experiment with respect to the hard panel including a patterned layer having different material from a base layer.
Figure 12:
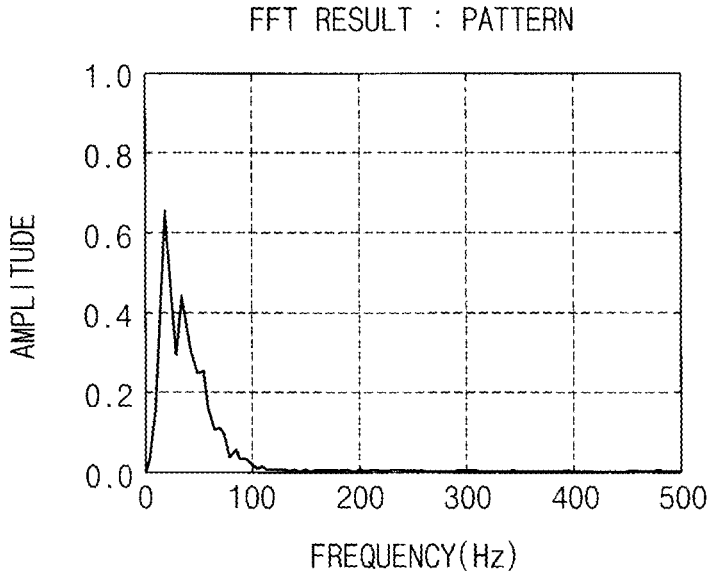

FIG. 12 is a graph illustrating a FFT result of acoustic wave reduction experiment with respect to the hard panel including a patterned layer having different material from a base layer. Particularly, in FIG. 12, FIG. 12 (*a*) shows a FTT of a sound energy according to a frequency when the patterned layer does not exist (i.e., the hard panel 10 having the patterned layer and the base layer is not included), and FIG. 12 (*b*) shows a FTT of a sound energy according to a frequency when the patterned layer is included (i.e., the hard panel 10 having the patterned layer and the base layer is included). Experimental and simulation conditions of FIG. 12 are shown in Table 3.

TABLE 3

| | Material | Density (g/cm$^3$) | Dynamic elastic modulus (GPa) |
|---|---|---|---|
| Medium 1 | MC Nylon | 1.15 | 9.48 |
| Medium 2 | ABS | 1.04 | 3.63 |

The sound energy of FIG. 12 (*b*) including the patterned layer may be remarkably reduced as compared with FIG. 12 (*a*). According to Snell's law, when the variation of the acoustic wave propagation speed or the variation of the acoustic impedance increases, floor noise reduction effect may increase.

[Embodiment 3]

In some embodiments, the patterned layer 100 in the hard panel 10 may be a single layer or multi layers.

Figure 13:
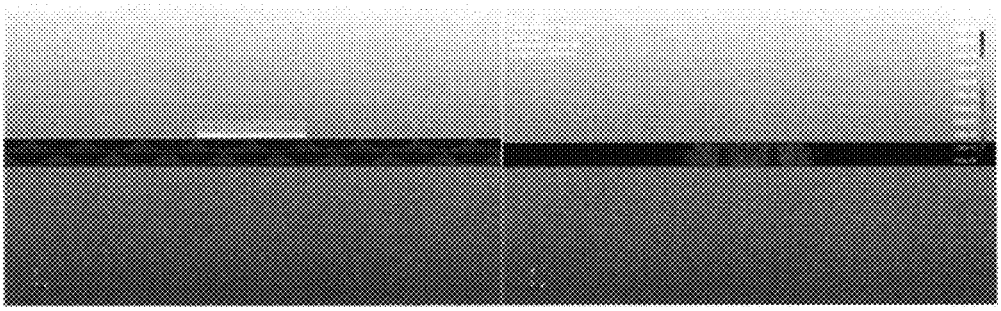
FIG. 13 is a cross-sectional view of a hard panel including a plurality of patterned layers according to example embodiments.
Figure 14:
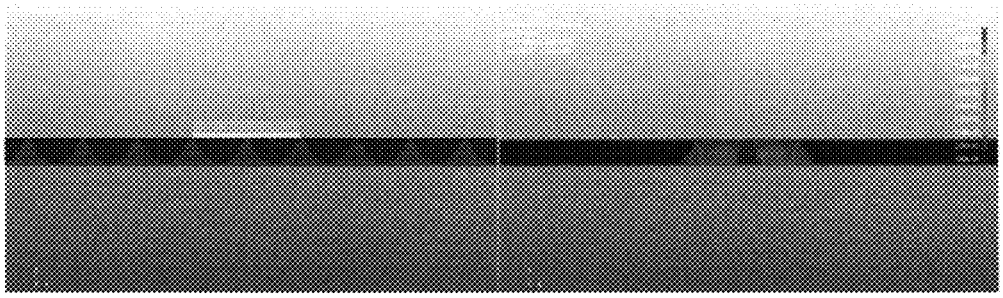
FIG. 14 is a cross-sectional view of a hard panel including a single patterned layer according to example embodiments.

FIG. 13 is a cross-sectional view of a hard panel including a plurality of patterned layers according to example embodiments. FIG. 14 is a cross-sectional view of a hard panel including a single patterned layer according to example embodiments.

Simulation conditions of the hard panel having multi-layered patterns of FIG. 13 are shown in Table 4.

| | Material | Density (g/cm$^3$) | Dynamic elastic modulus (GPa) |
|---|---|---|---|
| Medium 1 | PVC | 1.26 | 2.8 |
| Medium 2 | ABS | 1.50 | 9.8 |

Semicircle patterns may be formed in the plurality of layers. A thickness of the hard panel 10 is about 1 cm.

Simulation conditions of the hard panel having a single layer pattern of FIG. 14 are shown in Table 5.

| | Material | Density (g/cm$^3$) | Dynamic elastic modulus (GPa) |
|---|---|---|---|
| Medium 1 | PVC | 1.26 | 2.8 |
| Medium 2 | ABS | 1.50 | 9.8 |

Semicircle patterns may be formed in the single layer.

The hard panel having the single layer pattern may be more effective for the acoustic wave refraction and reflection than the hard panel having the multi-layered pattern. However, both the single layer pattern and the multi-layered pattern have the acoustic wave refraction and reflection effects, it is not limited to the number of the patterned layers 100.

[Embodiment 4]

Figure 15:
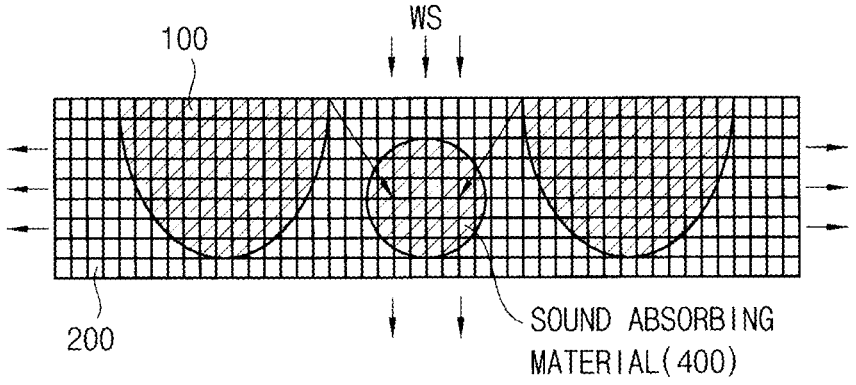
FIG. 15 is a cross-sectional view of a hard panel including a sound absorbing material according to example embodiments.

In some embodiments, the hard panel 10 may further include a sound absorbing material 400. FIG. 15 is a cross-sectional view of a hard panel including a sound absorbing material according to example embodiments. The sound absorbing material 400 may be formed between the patterned layers 100. The sound absorbing material 400 may absorb the acoustic wave WS passed the patterned layer 100 such that the floor noise may be more effectively reduced. The sound absorbing material 400 may include glass fiber, sponge, and/or the like. However, materials of the sound absorbing material 400 are not limited thereto.

[Embodiment 5]

In some embodiments, the patterned layer 100 of the hard panel 10 may have various shapes.

Figure 16:
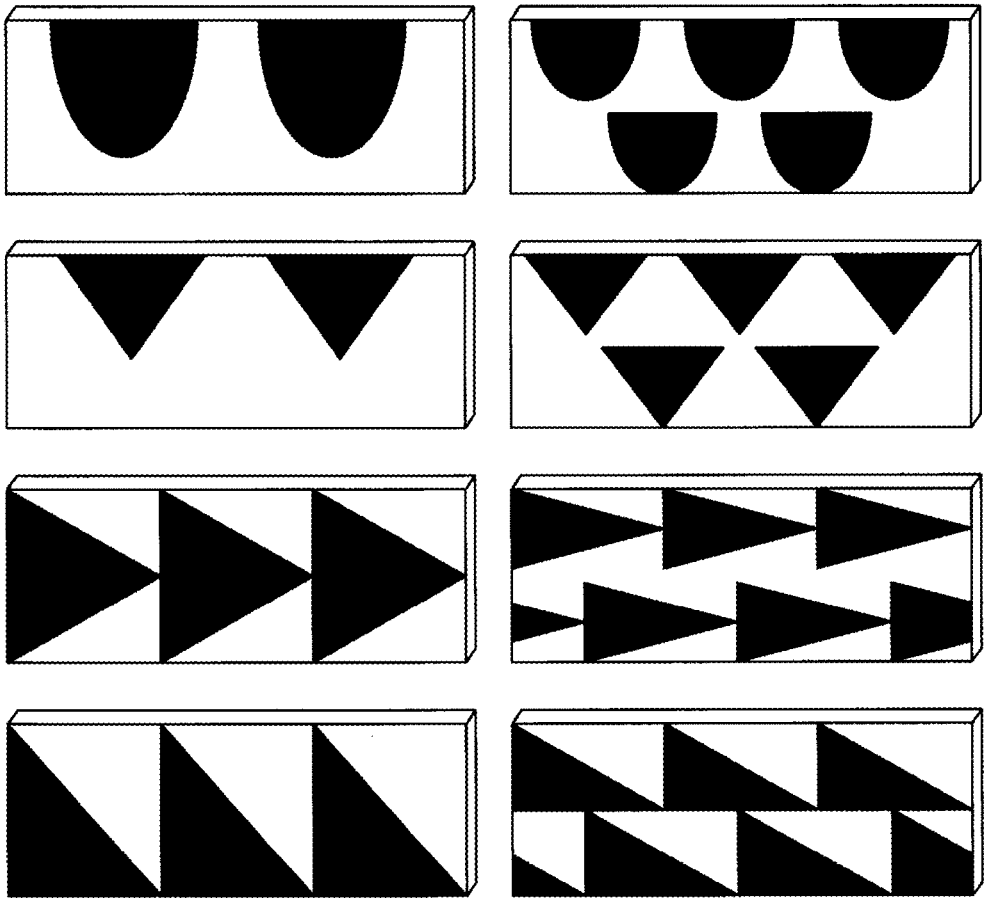
FIG. 16 is a diagram illustrating example of shapes of the patterned layer of a hard panel according to example embodiments.

FIG. 16 is a diagram illustrating example of shapes of the patterned layer of a hard panel according to example embodiments. The shape of the patterned layer 100 may be a semicircular pattern, an inverted triangle pattern, a right triangle pattern, an ellipse pattern, a wavy pattern, or the like.

[Embodiment 6]

In some embodiments, the patterned layer and the base layer may include at least one of polyvinyl chloride (PVC), aluminum, acrylonitrile butadiene styrene (ABS) resin, polylactic acid (PLA), metal, fiber, rubber, concrete, and mortar. A method of manufacturing the hard panel may be The hard panel may be manufactured using materials for generating the variation of the acoustic wave propagation speed and the variation of the acoustic impedance in the hard panel, such as using a mold, a 3D printer using PLA and ABS, a typical manufacturing method, or the like. A mold may be manufactured to make the hard panel 10.

[Embodiment 7]

Figure 17:
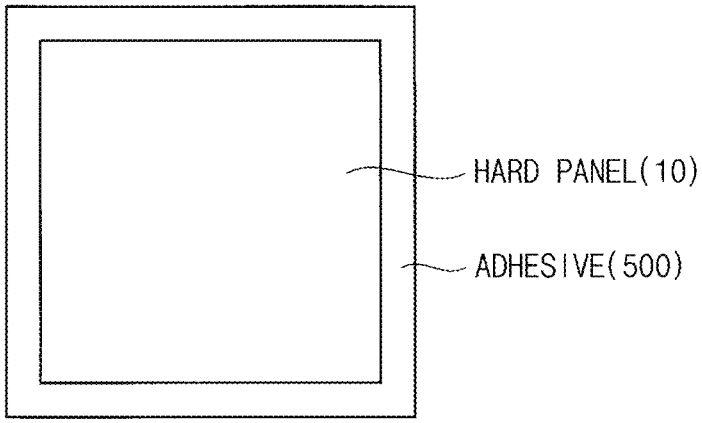
FIG. 17 is a plan view of a hard panel according to example embodiments.

In some embodiments, wall and floor structures for reducing floor impact sound may be variously constructed using the hard panel 10. FIG. 17 is a plan view of a hard panel according to example embodiments. An adhesive 500 may be applied between hard panels 10 to absorb horizontally changed noise. The hard panels 10 may be fixed with the adhesive 500 and/or hooks. In a construction method using the hard panels 10 of the wall and the floor for reducing floor impact sound, the hard panels 10 may be cured by an upper mold.

Figure 18:
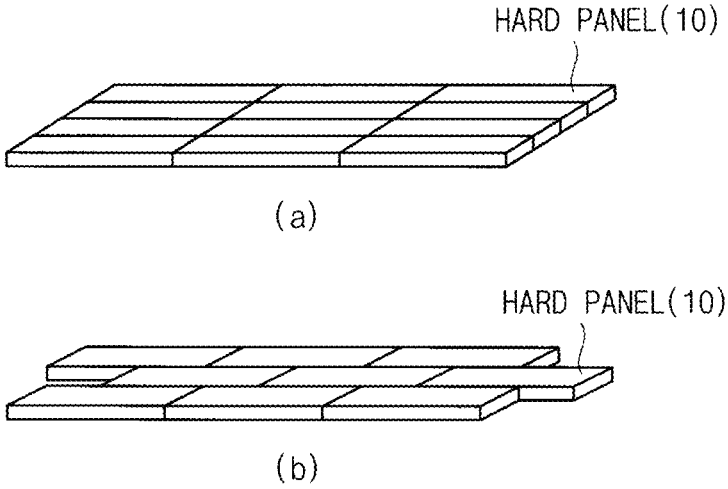
FIG. 18 a perspective view illustrating assemblies including a plurality of hard panels according to example embodiments.

FIG. 18 a perspective view illustrating assemblies including a plurality of hard panels according to example embodiments. Particularly, in FIG. 18, FIG. 18 (*a*) shows that joint portions of the hard panels 10 are tiled, and FIG. 18 (*b*) shows that joint portions are arranged in a staggered manner. The arrangement of the hard panels 10 may be controlled according to construction sites.

Figure 19:
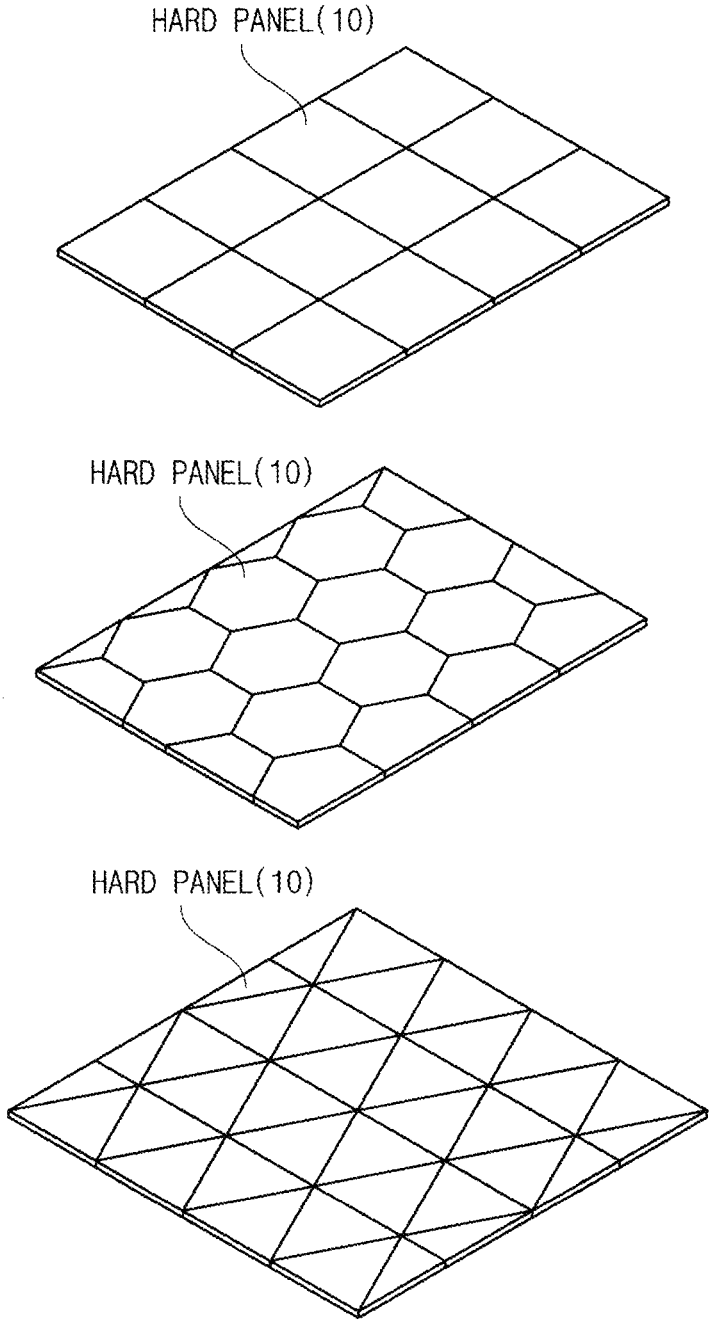
FIG. 19 is a perspective view illustrating assemblies including hard panels having various shaped according to example embodiments.

FIG. 19 is a perspective view illustrating assemblies including hard panels having various shaped according to example embodiments. The hard panels 10 may be tetragonal shapes, triangle shapes, or polygonal shapes according to construction sites.

Figure 20:
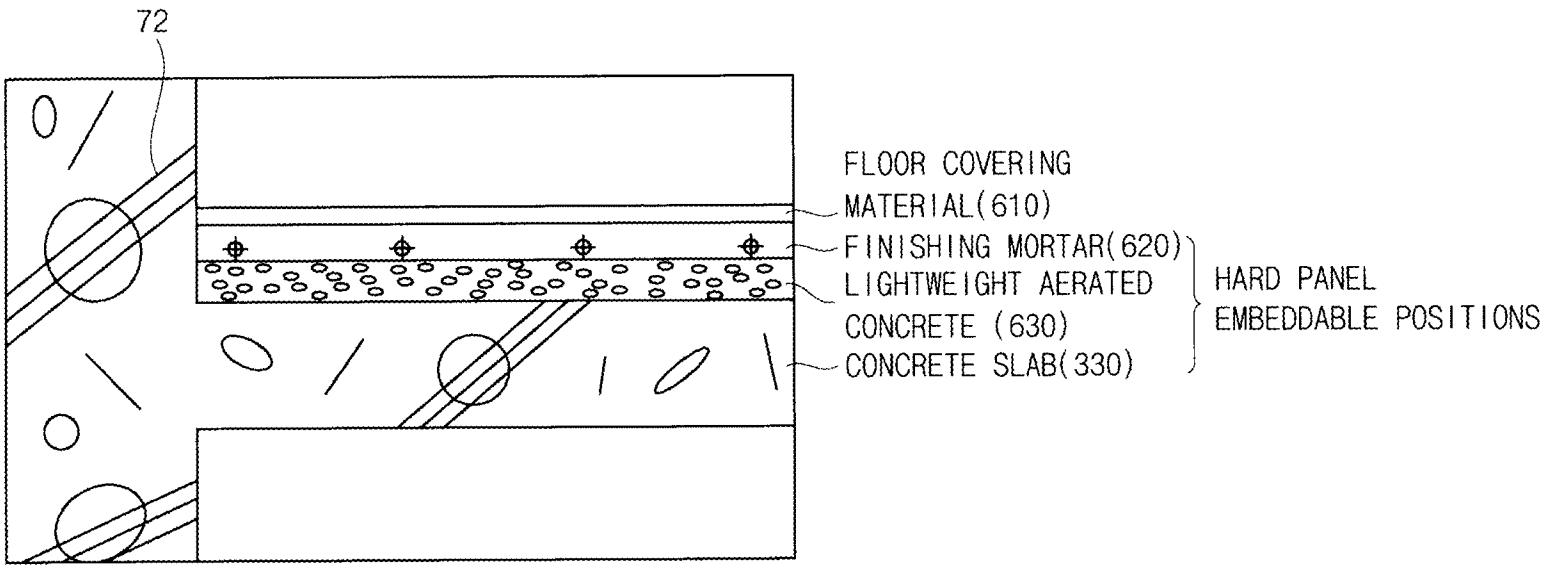
FIG. 20 is a floor structure diagram illustrating positions where a hard panel according to example embodiments can be reclaimed.

FIG. 20 is a floor structure diagram illustrating positions where a hard panel according to example embodiments can be reclaimed.

In some embodiments, the hard panel of the wall and/or floor structures may be reclaimed in a floor when a new building is constructed. The hard panel 10 may be included in at least one of a concrete slab 330, a lightweight aerated concrete 630, and a finishing mortar 620.

A hard panel assembly including a plurality of hard panels 10 may be placed on the floor or wall of an existing building. The hard panels 10 may be bonded by an adhesive or the like. The adhesive may be silicon, epoxy resin, mortar, or the like. The hard panels 10 may be connected by connecting hooks without the adhesive. A longitudinal acoustic wave WS in the hard panel 10 may be absorbed by providing an adhesive or a space at each connecting portion of the hard panel 10.

The hard panel 10 of the wall and floor structure for reducing floor impact sound may be applied not only to the floor of the building but also to the wall 72 and the like, so that it can be used as a soundproofing material and also as a noise reduction material.

[Embodiment 8]

In some embodiments, the thickness of the hard panel 10 may be about 4 mm to about 50 mm. The hard panel 10 may be manufactured to about 4 mm, which is similar to the general thickness of general flooring. It is featured that space occupancy is increased, and it is easy to carry and install. Also, thicknesses and the number of patterned layers of the hard panel 10 may be adjusted according to the place and purpose of installation, and various patterns may be mixed and manufactured.

In some embodiments, the hard panels 10 may be placed between the concrete slab 330 and the lightweight aerated concrete 630, between the lightweight aerated concrete 630 and the finishing mortar 620, and/or between the finishing mortar and a floor covering material 610 when the hard panels 10 are reclaimed in the floor of an existing building or a newly-built building. In some embodiments, the hard panels 10 may be included in at least one of the concrete slab 330, the lightweight aerated concrete 630, the finishing mortar 620, and the floor covering material 610 when the hard panels 10 are reclaimed in the floor of the existing building or the newly-built building. In some embodiments, the hard panels 10 may be placed as a floor structure on/in the floor of the existing building or a newly-built building. In some embodiments, the hard panels 10 may be placed as a wall structure on/in the wall of the existing building or a newly-built building.

What is claimed is:

1. A hard panel of wall and floor structures for reducing floor impact sound, comprising:

a base layer including a first medium; and a patterned layer including a second medium and closely making contact with the base layer to form the hard panel, the patterned layer having a semicircle pattern, wherein at least one of the densities and elastic moduli of the first medium and the second medium are different from each other to generate a difference of an acoustic wave propagation speed between the patterned layer and the base layer and a difference of an acoustic impedance between the patterned layer and the base layer, an acoustic wave propagation speed ratio of the patterned layer to the base layer is greater than 1, and an acoustic impedance ratio of the patterned layer to the base layer is greater than 1.

2. The hard panel of claim 1, wherein an incident acoustic wave perpendicular to the hard panel is refracted at a boundary surface between the patterned layer and the base layer and is propagated in a horizontal direction of the hard panel.

3. The hard parcel of claim 1, wherein an incident acoustic wave is refracted at a boundary surface between the patterned layer and the base layer and a moving distance of the refracted acoustic wave in the hard panel increases such that sound energy is dissipated.

4. The hard panel of claim 1, wherein an incident acoustic wave is totally reflected back at a boundary surface between the patterned layer and the base layer and a phase of the incident acoustic wave is reversed such that the incident acoustic wave and the totally reflected acoustic wave cancel each other out.

5. The hard panel of claim 1, wherein the patterned layer is formed by a single layer or a multi-layer.

6. The hard panel of claim 1, wherein a medium of the hard panel comprises at least one of polyvinyl chloride (PVC), aluminum, acrylonitrile butadiene styrene (ABS) resin, polylactic acid (PLL), metal, fiber, rubber, concrete, and mortar.

7. The hard panel of claim 1, further comprising:

a sound absorbing material between adjacent patterns of the patterned layer.

8. A construction method using a plurality of hard panels of the wall and floor structures for reducing floor impact sound of claim 1, the method comprising:

forming the hard panels each having a square mat with a tile type; and bonding the hard panels using an adhesive.

9. A construction method using a plurality of hard panels of the wall and floor structures for reducing floor impact sound of claim 1, the method comprising:

curing the hard panels using an upper mold.

10. The construction method of claim 8, further comprising:

placing a combination of the hard panels in a checkerboard arrangement or a zigzag arrangement on the floor of an existing building.

11. The construction method of claim 8, further comprising:

reclaiming the hard panels in the floor of an existing building or a newly-built building.

12. The construction method of claim 8, wherein the hard panels are between a concrete slab and a lightweight aerated concrete, between the lightweight aerated concrete and a finishing mortar, and between the finishing mortar and a floor covering material when the hard panels are reclaimed in the floor of an existing building or a newly-built building.

13. The construction method of claim 8, wherein the hard panels are included in at least one of a concrete slab, a lightweight aerated concrete, a finishing mortar, and a floor covering material when the hard panels are reclaimed in the floor of an existing building or a newly-built building.

* * * * *